US007659672B2

(12) United States Patent
Yang

(10) Patent No.: US 7,659,672 B2
(45) Date of Patent: Feb. 9, 2010

(54) LED DRIVER

(75) Inventor: Shen Yang, Wuhan (CN)

(73) Assignee: O2Micro International Ltd., Georgetown (KY)

( * ) Notice: Subject to any disclaimer, the term of this patent is extended or adjusted under 35 U.S.C. 154(b) by 464 days.

(21) Appl. No.: 11/541,406

(22) Filed: Sep. 29, 2006

(65) Prior Publication Data

US 2008/0088254 A1 Apr. 17, 2008

(51) Int. Cl.
*G05F 1/00* (2006.01)
*H05B 37/02* (2006.01)

(52) U.S. Cl. ..... 315/224; 315/291

(58) Field of Classification Search ..... 315/291, 315/307, 312, 224; 323/224, 278, 282, 290, 323/292, 316, 318–319, 276, 280; 362/800
See application file for complete search history.

(56) References Cited

U.S. PATENT DOCUMENTS 7,049,752 B2 5/2006 Tani
7,071,630 B1 * 7/2006 York ..... 315/224
7,138,786 B2 * 11/2006 Ishigaki et al. ..... 323/224
7,262,588 B2 * 8/2007 Matsuo et al. ..... 323/282
2007/0115662 A1 * 5/2007 Roberts et al. ..... 362/252
2007/0229001 A1 * 10/2007 McIntosh et al. ..... 315/307

FOREIGN PATENT DOCUMENTS

CN 2452246 Y 10/2001

* cited by examiner

*Primary Examiner*—Douglas W. Owens
*Assistant Examiner*—Minh Dieu A
(74) *Attorney, Agent, or Firm*—Wang Law Firm, Inc.; Li K. Wang

(57) ABSTRACT

The present invention provides a flexible light emitter driver circuit which adjusts the luminance of the light emitter diodes (LED) by a manual input signal. The light emitter driver circuit comprises a Duty Ratio Change Logic, a PWM Generate and Control Logic, an oscillator, and a gate driver. The Duty Ratio Change Logic adjusts the duty cycle of the output signal according to the manual input signal. The PWM Generate and Control Logic generates a PWM signal according to the output signal to control the current of the LED, thus adjusts the luminance of the LED. The present invention further provides a highly flexible display system that comprises a light emitter driver circuit which can adjust the LED luminance by manual input signal.

16 Claims, 5 Drawing Sheets

LED DRIVER

FIELD OF THE INVENTION

The present invention relates to light emitting diode (LED) based display systems, and more particularly to a driver circuit in display systems.

BACKGROUND OF THE INVENTION

Traditionally, incandescent and fluorescent illuminating devices have been used as light sources in some simple devices such as radio. However, significant advances in the light emitting diode (LED) technology have made LEDs attractive for use in more and more fields, such as automobiles and other devices, because of their long operating life, high efficiency, and low profile.

The electrical characteristics of LEDs are such that small changes in the voltage applied to a LED will cause appreciable changes in the current that passes through the LED. The LED luminance is proportional to the LED current and, a small change in the voltage will cause an appreciable change in the LED luminance. Currently, LED drivers use driver circuits that include voltage source outputs with current limiting resistors or linear current regulators. Current limiting resistors will cause power loss, in these ways, current adjustment method with current limiting resistors or linear current regulators is not precise. Driving LEDs with a current larger than a reference current can reduce the LED's life and produce unpredictable light output. As the application of the LED in the automotive industry expands to include high power applications, such as the rear combination lights (Stop/Turn/Tail), the performance of these driver circuits is no longer acceptable in terms of efficiency and regulation. It would be desirable to have a driver circuit for LEDs that would overcome the above disadvantages.

Nowadays, LEDs are used in many new fields because of their environmental durability, long-time durability, high optics efficiency, etc.; consequently, the LED driver and its design also gained more attention. Because of different manufacturing processes employed by different LED manufacturers, the electrical characteristics of the LEDs from one manufacturer may differ greatly from the electrical characteristics of the LEDs from another manufacturer. Furthermore, the electrical characteristics of the LEDs may also vary according to different types of LEDs. Typically, when the forward voltage ($V_F$) of the LED exceeds 3.6 V, even a small increase of the $V_F$ will cause the forward current ($I_F$) to substantially increase. The rapid increase of $I_F$ will cause the LED to be brighter and hotter, thus accelerating the LED consumption, shortening the LED's useful life, even destroying the LED. Based on the characteristics of the voltage-current change ratio, the LED driver needs a competent design.

There are two types of LED driver chips comply with high-power LED-driver and general LED-driver. Technically, in order to connect more LEDs, the LED driver chips usually use inductor for storage power and PWM pulses which generate internally from the LED chips to drive the LEDs. There are two ways for adjusting a LED's luminance: by regulating the PWM duty ratio and by regulating a LED's bypass current. The method of adjusting LED's luminance by regulating the PWM duty ratio can be used in the devices that comprise CPU. Regulating a LED's bypass current through a potentiometer does not yield to accurate adjustment because under a constant voltage the LED current changes nonlinearly. Consequently, this method causes imprecise light adjustment and light flickers.

Due to LED voltage-current change characteristics, it is recommended to use a constant voltage to drive a LED. Though the Low Drop Out Regulators (LDO) are not precise and not adequate to stabilize currents, the LDOs are commonly used with the LEDs.

Most of the LED chips nowadays use PWM to control the LED luminance. In order to assure people do not see the PWM pulse, the frequency of the PWM pulse must be higher than 100 Hz. But the LED chips are generally designed for adjustment of the LED luminance during the operation. Some chips in the market allow the adjustment of the LED luminance through regulating the PWM pulse, but the adjustment cannot be done manually. However, in practical applications, such as smart lighting, advertisement, automobile, etc., manual luminance adjustment is preferred. Furthermore, it is hoped when the LED's luminance is adjusted by manually, the LED luminance can be adjusted linearly or proximately linearly.

Therefore, it is needed a system that allows easy and linear adjustment of the LED's luminosity without negatively impacting on the LED's performance, and it is to such system and method the present invention is primarily directed.

SUMMARY OF THE INVENTION

According to one embodiment of the present invention there is provided a display system architecture for managing LCD backlight. The display system comprises a programmable Central Processing Unit (CPU), at least one input/output protocol for communicating with components on the display system, a LCD module for displaying visual information, an array of light emitters for providing backlighting to the LCD module, an array of light emitter driver circuits which control the intensity of light emitters, and an array controller which connects to a number of light emitter driver circuits.

According to another embodiment of the present invention there is provided a LED driver architecture for driving the LEDs. The LED driver comprises at least one pin used to input pulses which indicates the wanted luminance of the LEDs. The LED driver comprises a Duty Ratio Change Logic which changes the PWM duty cycle according to the pulse input. The LED driver comprises a PWM Generate and Control Logic for generating PWM according to the duty cycle. The LED driver further comprises temperature and over-voltage protection Over-voltage Protect circuits which protect circuits under the over-thermal and over-voltage embodiment.

BRIEF DESCRIPTION OF THE DRAWINGS

Advantages of the present invention will be apparent from the following detailed description of exemplary embodiments thereof, which description should be considered in conjunction with the accompanying drawings, in which.

DETAILED DESCRIPTION

Figure 1:
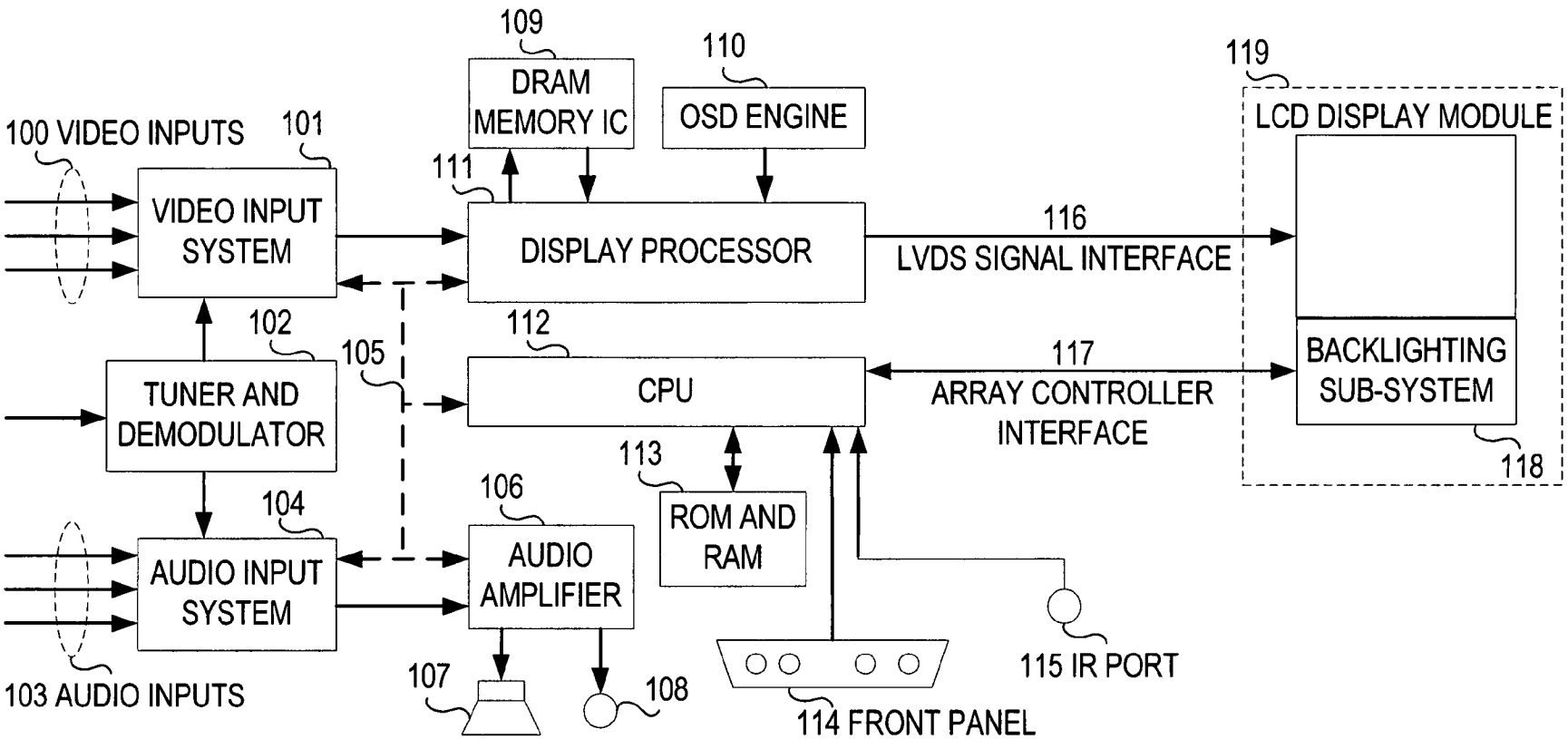
FIG. 1 illustrates a diagram of a light emitter diodes (LED) based display system, in accordance with one embodiment of the present invention.

FIG. 1 illustrates a system diagram of a light emitter diodes (LED) based display system. The system includes a video input system 101 that accepts a plurality of analog and digital video inputs 100. The video inputs 100 may include analog composite video, Composite Video Broadcast Signal (CVBS)-type supporting National Television Systems Committee (NTSC), Phase Alternating Line (PAL), and/or Sequential Electronic Color With Memory (SECAM) variety; although an analog-to-digital (A2D) conversion is performed and further video decoding, including but not limited to conventional 2D or three-dimensional (3D) comb filtering, is performed to generate a good digital representation of the analog video inputs 100.

The video input system 101 may support different methods for delivering images to a display system, such as a Digital Visual Interface (DVI) method, DVI-HDCP (High-bandwidth Digital Content Protection), High Definition Multimedia Interface (HDMI), a traditional PC monitor analog RGB type, and many other choices. The traditional PC monitor analog RGB type may includes eXtended Video Graphics Array (xVGA), a component YCbCr analog variety interfaced through a D4 connector, and a digital S-Video connection. Generally, the video input system 101 includes a high-speed A2D conversion and logic to create a digital representation of the video input 100. A display processor 111 receives the digital representation of the video input 100 through a digital video signal interface for further processing and image rendering. Some display processors may integrate the video input system 101.

The display system shown in FIG. 1 includes a TV tuner and demodulator system 102 for receiving RF signals for terrestrial television reception, whereas state-of-the-art tuners and demodulator systems 102 support digital TV reception using standard protocols such as Digital Video Broadcasting Terrestrial (DVB-T), Advanced Television Systems Committee (ATSC), and Association of Radio Industry Business (ARIB). The TV tuner and demodulator system 102 generally provides video decoding, and may pass the video data to the video input system 101. Alternatively, the TV tuner and demodulator system 102 can directly interface with a secondary auxiliary digital video signal interface of a display processor 111. Furthermore, the data channel for digital TV broadcast is decoded by either the tuner and demodulator system 102. In the case of receiving digital TV broadcasts based on the MPEG-2 compression algorithm, an MPEG-2 transport stream (TS) received from the digital TV broadcast can be delivered to a highly-integrated display processor 111.

Although state-of-the-art display processor 111 integrate video decoding functions, they may not include the tuner and demodulator 102 elements. However, state-of-the-art tuners are manufactured in a semiconductor manufacturing process. It is conceived that a display processor 111 may integrate the TV tuner and demodulator system 102, in one embodiment of the present invention.

For analog and digital TV reception, the tuner and demodulator system 102 outputs the audio information to an audio input system 104. The audio input system 104 accepts audio information from a variety of external audio sources 103, such as audio/video (AV) analog audio inputs, tuner inputs, and PC audio inputs. Generally, the audio input system 104 outputs at least a left and right channel of stereo audio to an audio amplifier 106, which drives sound systems such as a speaker system 107 or a headphone jack system 108.

The display system of FIG. 1 implements a programmable CPU sub-system 112, which is generally either an 8-bit discrete processor, or a 32-bit Reduced Instruction Set Computer (RISC) processor integrated inside the display processor 111. The programmable CPU sub-system 112 interfaces with random Access Memory (RAM) and Read Only Memory (ROM) memory 113, which may be integrated into the CPU sub-system 112, and operates an instruction set to control system functions, such as interfacing with a front input panel 114 for volume and channel control, receiving control signals through an infrared (IR) port 115, setting parameters of the display module, configuring system devices, etc. An input/output bus interface protocol 105 is used to communicate with other system devices. According to one embodiment, the input/output bus interface protocol 105 is a Philips I2C protocol. The I2C interface 105 can select a video input source from the video input system 101, and can select an audio source 103 from the audio input system 104.

In some systems, a CVBS input to the CPU sub-system 112 can provide a programmable on-screen display (OSD), closed-caption, feature that can output data through the input/output bus interface protocol 105 connection to the display processor 111 for overlay with a primary video channel. In some systems, the OSD features are provided by a secondary CPU, or fixed-function component, called an OSD engine 110 that passes data directly to the display processor 111. Some state-of-the-art display processors 111 integrate the OSD engine 110 in one embodiment. Some state-of-the-art display processors 111 integrate the programmable CPU sub-system 112 in one embodiment.

The display processor 111 generally includes de-interlacing technology to convert inputs from an interlaced data format, such as provided by NTSC/PAL/SECAM analog video, to a progressive scan type format. This generally requires large amounts of the video frame memory, conventionally provided by an external DRAM memory IC device 109. The display processor 111 generally executes scaling algorithms to fit video images to a target display size, algorithms such as filters to smooth edges on video images, and color space conversion algorithms. In many cases, display processor 111 executes methods of overlay more than one video source, called Picture On Picture (POP) and Picture In Picture (PIP), that scale the image specifically for the purpose of overlaying or displaying side-by-side multiple video sources.

The display processor 111 outputs a high-speed low voltage differential signal 116 (LVDS) that multiplexes red, green, blue pixel color information before passing the color information to the target display. The display processor 111 may include an embedded D2A circuit capable of generating LVDS signal interface 116. Alternatively, the display processor 111 may relay on an external D2A circuit for such generating function. The LVDS signal interface 116 is utilized for LCD display modules 119, such as plasma display modules, and other types, in one embodiment. Other display module interface technologies, such as Peripheral Component Interconnect Express (PCI-Express), may also be used in other embodiment.

In the case of the LCD display module 119 of this invention, a backlighting sub-system 118 is connected to the programmable CPU 112 through an array controller interface 117, preferably implemented according to the Philips I2C bus interface protocol. Alternatively, the array controller interface 117 could be implemented according to the universal asynchronous transmit/receive (UART) interface protocol, and the universal serial bus (USB) protocol. The array controller interface 117 may also be implemented through a generic 8-bit slave interface.

The array controller interface 117 is used to transmit desired intensity information to the backlight sub-system 118. Desired intensity information is obtained through user input by means of the front input panel 114 interface. A default intensity configuration is created by a configuration procedure during the display system manufacturing process. A color feedback management method reads color sensor information from the display module 119 and determines a new intensity value for at least one light emitter on the backlighting sub-system 118 in accordance with embodiments of the present invention.

Figure 2:
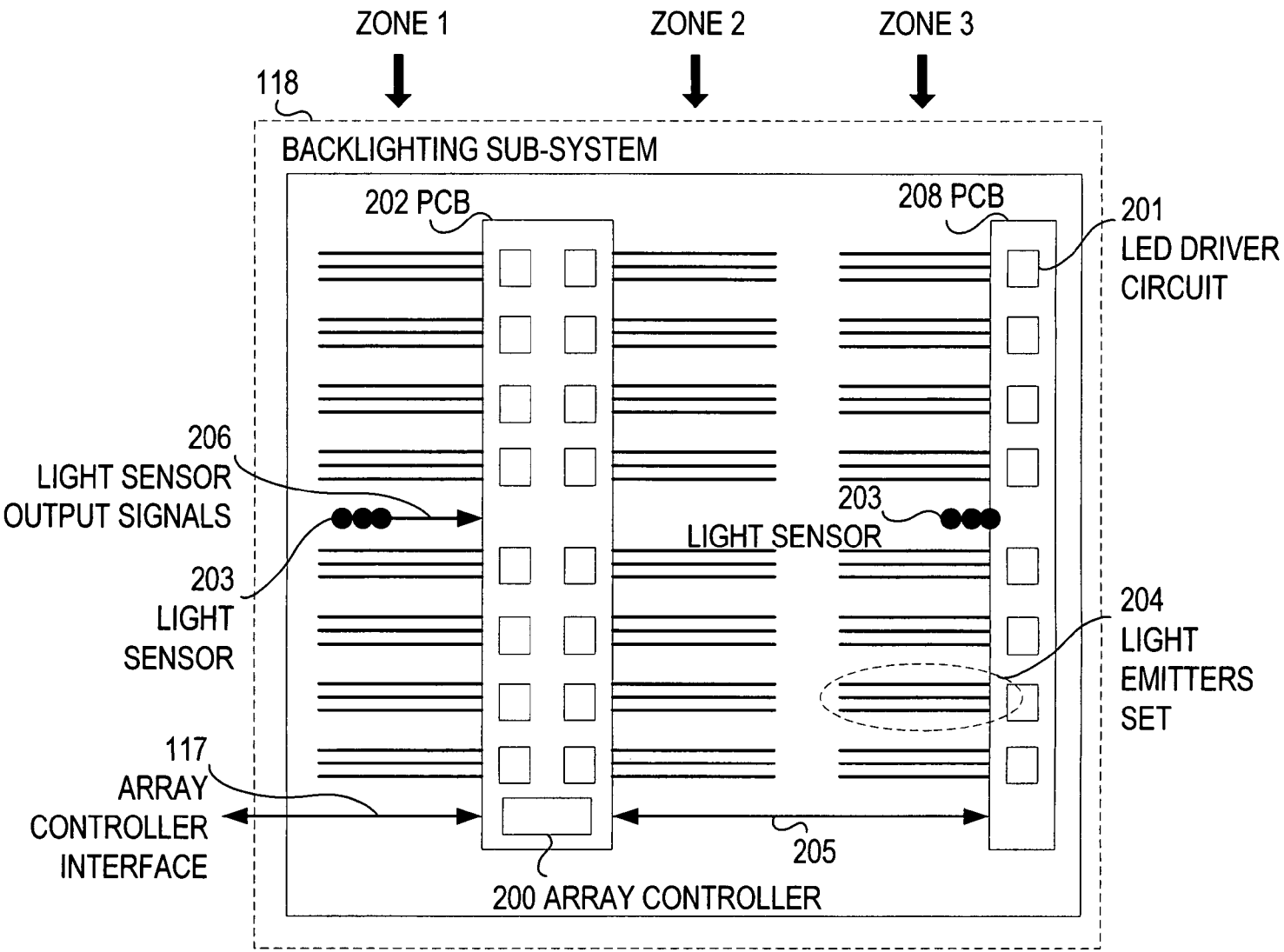
FIG. 2 illustrates a diagram of the LCD backlight subsystem of FIG. 1, in accordance with one embodiment of the present invention.

FIG. 2 illustrates in more detail the LCD backlighting sub-system 118 of FIG. 1. In this embodiment, three backlighting zones are defined, each zone comprises one-third of the total light-emitters of the backlighting system. This embodiment configuration defines zone 1 as left-side vertical column, zone 2 as middle vertical column, and zone 3 as right-side vertical column. The backlighting is provided by sets of light emitters; each light emitter set 204 comprising three light emitters of primary colors; preferably red color, green color, ad blue color to optimize the limited RGB color gamut to best represent the range of human color perception. The light emitter set 204 comprises a set of strings of light emitting diode (LED) devices, where each string provides one of the three primary colors. The LED devices are used for its low cost. Other methods of generating light, such as fluorescent lamps, may also be used. LCD backlighting sub-system 118 comprises two printed circuit boards 202 and 208, and a plurality of light emitter driver circuits 201 for controlling the light emitter set 204. The printed circuit board 202 comprises an array controller 200 for controlling the LCD backlighting sub-system 118. In this embodiment, the LCD backlighting sub-system 118 further comprises two sets of light sensors 203, and each set includes a red sensor, a green sensor, and a blue sensor. The light sensors 203 uses light sensor output signals 206 for communicating the backlighting related data produced by the light emitter set 204 with the display processor 111.

Since the array controller 200 comprises an intensity control interface to each light emitter driver circuit 201, an input path from the light sensors 203 to input feedback intensity data of the light emitters into the array controller 200 and a board-to-board interface 205 to pass intensity information between the two PCBs 202 and 208. The PCB with the array controller 200 includes an array controller interface 117, which may be implemented according to the Philips I2C bus interface protocol, to communicate with a display system CPU 112.

Figure 3:
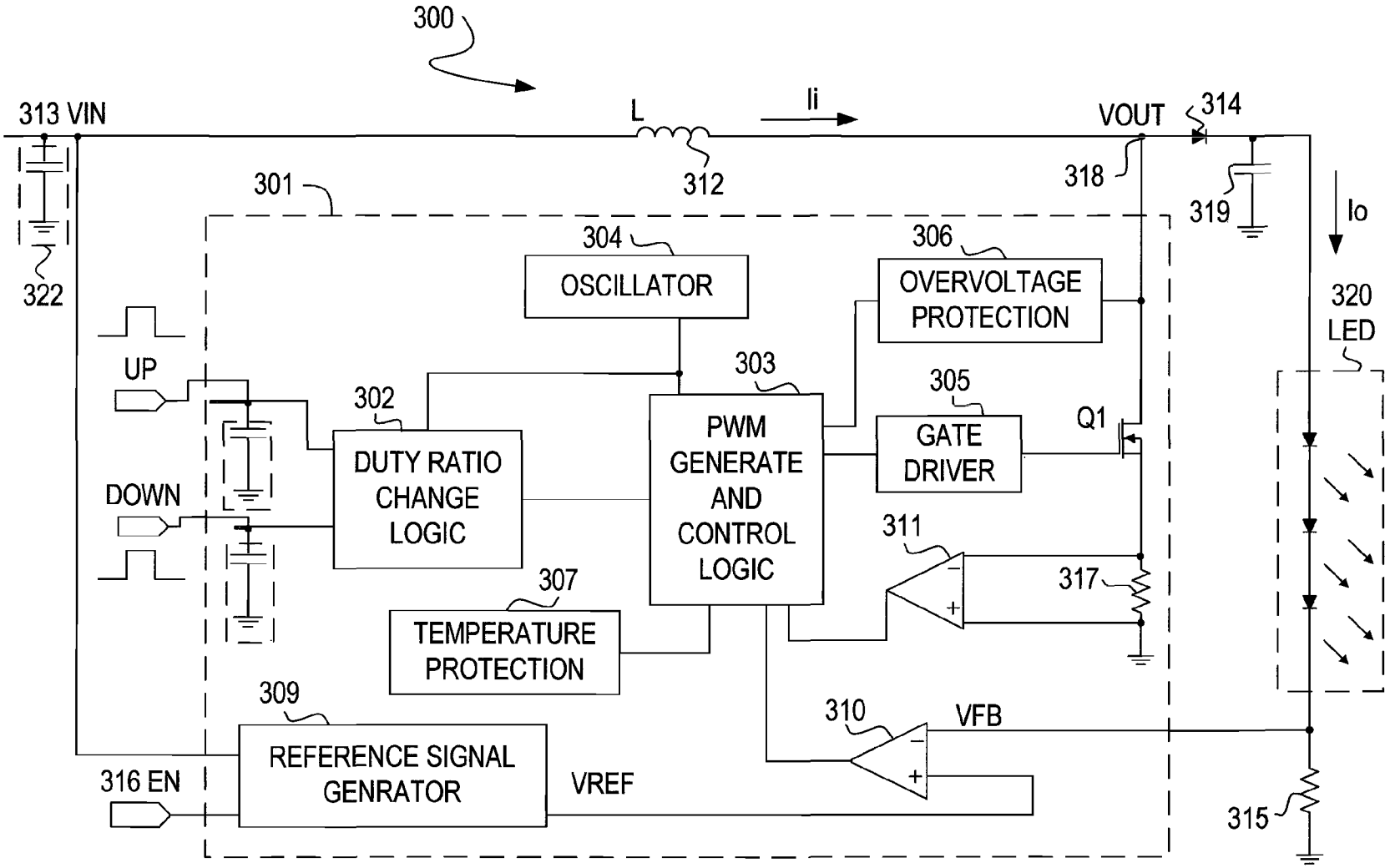
FIG. 3 illustrates a diagram of the LED driver circuit of FIG. 2, in accordance with one embodiment of the present invention.

FIG. 3 illustrates a diagram of a LED driver system 300 that comprises an LED driver circuit 301 (201 in FIG. 2), a power storage element, and a couple of light emitting diodes (LED) 320. In this embodiment, the power storage element is an inductor 312, and the LED driver circuit 301 integrates necessary circuits to control the intensity of LED 320. The LED driver circuit 301 comprises a Duty Ratio Change Logic 302 (a first logic), a PWM Generate and Control Logic 303 (a second logic), an oscillator 304, a comparator 310, a Gate Driver 305, and a switch Q1.

The comparator 310 accepts a reference signal, for example a Vref signal that indicates a desired luminance of the LEDs 320. The Vref can be a reference signal which is generated by a Reference Signal Generator 309 according to the voltage of the power supply Vin 313.

The Reference Signal Generator 309 accepts an EN signal 316, which controls the enabling or disabling of the LED driver circuit 301. When the EN signal 316 is high, the Reference Signal Generator 309 outputs the Vref according to the voltage of the power supply Vin 313 and the LED driver circuit 301 is set to operate. When the EN signal is low, the Reference Signal Generator 309 outputs zero which stops the PWM Generate and Control Logic 303 generating the PWM signals and the LED driver 301 is disabled.

External capacitors 322 are connected to the Vin 313 for smoothing the input voltage. The comparator 310 also accepts a feedback signal, for example a Vfb that represents the feedback voltage of a feedback resistance 315. The feedback resistance 315 is coupled with the LEDs 320 and the voltage of the feedback resistance is proportional to the current of the LEDs 320.

The comparator 310 compares the reference voltage Vref and the feedback voltage Vfb and outputs a signal to the PWM Generate and Control Logic 303. The oscillator 304 provides a timing signal to the PWM Generate and Control Logic 303 for timing reference. The timing signal from the oscillator 304 can be, but not limited to, saw-tooth wave, triangle wave, and so on. The timing signal has a constant frequency. The PWM Generate and Control Logic 303 generates a PWM signal according to the output of the comparator 310 and the oscillating signal from the oscillator 304. The PWM signal has the same frequency of the time reference signal from the oscillator 304.

The Gate Driver 305 accepts the PWM signal from the PWM Generate and Control Logic 303 and converts to a voltage to control the opening and closing of the switch Q1. The switch Q1 and the inductor 312 are coupled in series between the power supply Vin and the ground. In this embodiment, the switch Q1 is an N type metallic oxide semiconductor field effect transistor (MOSFET), the lead pole of the switch Q1 is coupled to the inductor 312, the source pole is coupled to the ground through the resistance 317, and the gate pole is controlled by the output of the Gate Driver 305.

When the PWM signal is high, the switch Q1 is closed. The current of the power supply Vin 313 flows to ground through the inductor 312 and the switch Q1. The power generated by the current flow is stored in the inductor 312. The inductor 312 is charged. The inductor 312 will store more power when the duration of the high pulse of the PWM signal increases. When the PWM signal changes from high to low, the switch Q1 is open and the power stored in the inductor 312 is released as a current. The current charges the capacitor 319 through a Schottky diode 314, which is coupled between the inductor 312 and the LEDs 320. The voltage of the capacitor 319 generates a current Io. The LEDs 320 are driven by the current Io. The liquid crystal display (LCD) equipped with the LEDs, for example the display of a mobile phone, will be lighted.

In this embodiment, the luminance of the LEDs 320 can be conveniently adjusted by a manual input signal. The manual input signal can be, for example a digital signal. The digital signal is derived from an analog signal which is inputted by pressing a button of a mobile phone for a pre-determined period of time.

The Duty Ratio Change Logic 302 has two input pins (connector), a first (UP) pin and a second (DOWN) pin, for accepting the manual input signal. The Duty Ratio Change Logic 302 sends an output control signal to the PWM Generate and Control Logic 303 in response to the manual input signal. The PWM Generate and Control Logic 303 adjusts an output PWM signal according to the control signal from the Duty Ratio Change Logic 302. The luminance of the LEDs 320 is proportional to the duty cycle of the PWM signal. Therefore, the luminance of the LEDs can be adjusted.

The LED driver circuit 301 further comprises a monitor 311. The two pins of the monitor 311 are coupled to the resistance 317. The monitor 311 monitors the current of the resistance 317 and output a signal to the PWM Generate and Control Logic 303 to assure the duty cycle of the output PWM signals is stable. When the duty cycle of the PWM signals is stable, the LED's current can be kept stable, thus flickering of the lighting is prevented.

As with any current source, the output voltage rises as the output impedance increases or is disconnected. To prevent the output voltage from exceeding a maximum main switch voltage, an overvoltage protection circuit 306 is integrated. The overvoltage protection circuit 306 monitors the input voltage of the LEDs 320. When the input voltage exceeds a predetermined overvoltage protection (OVP) threshold voltage, the overvoltage protection circuit 306 will send a stop signal to the PWM Generate and Control Logic 303 to stop generation the PWM signals, thus protecting the LEDs 320 from destruction. As long as the input voltage is below the OVP threshold, the overvoltage protection circuit 306 continues normal operation.

To prevent the temperature of the LEDs 320 from exceeding a maximum value, an internal temperature protection circuit 307 is implemented in the present embodiment. The temperature protection circuit 307 monitors the thermal of the LEDs 320. When the temperature of the LEDs 320 exceeds a pre-determined temperature threshold value, the temperature protection circuit 307 will send a stop signal to the PWM Generate and Control Logic 303 to stop generating the PWM signals and to protect the LEDs 320 from destruction.

The PWM Generate and Control Logic 303, the Duty Ratio Change Logic 302, the oscillator 304, the comparator 310, the monitor 311, the Gate Driver 305, the switch Q1, the Reference Signal Generator 309, the overvoltage protection circuit 306, and the temperature protection circuit 307 can be integrated in one single chip.

Figure 4:
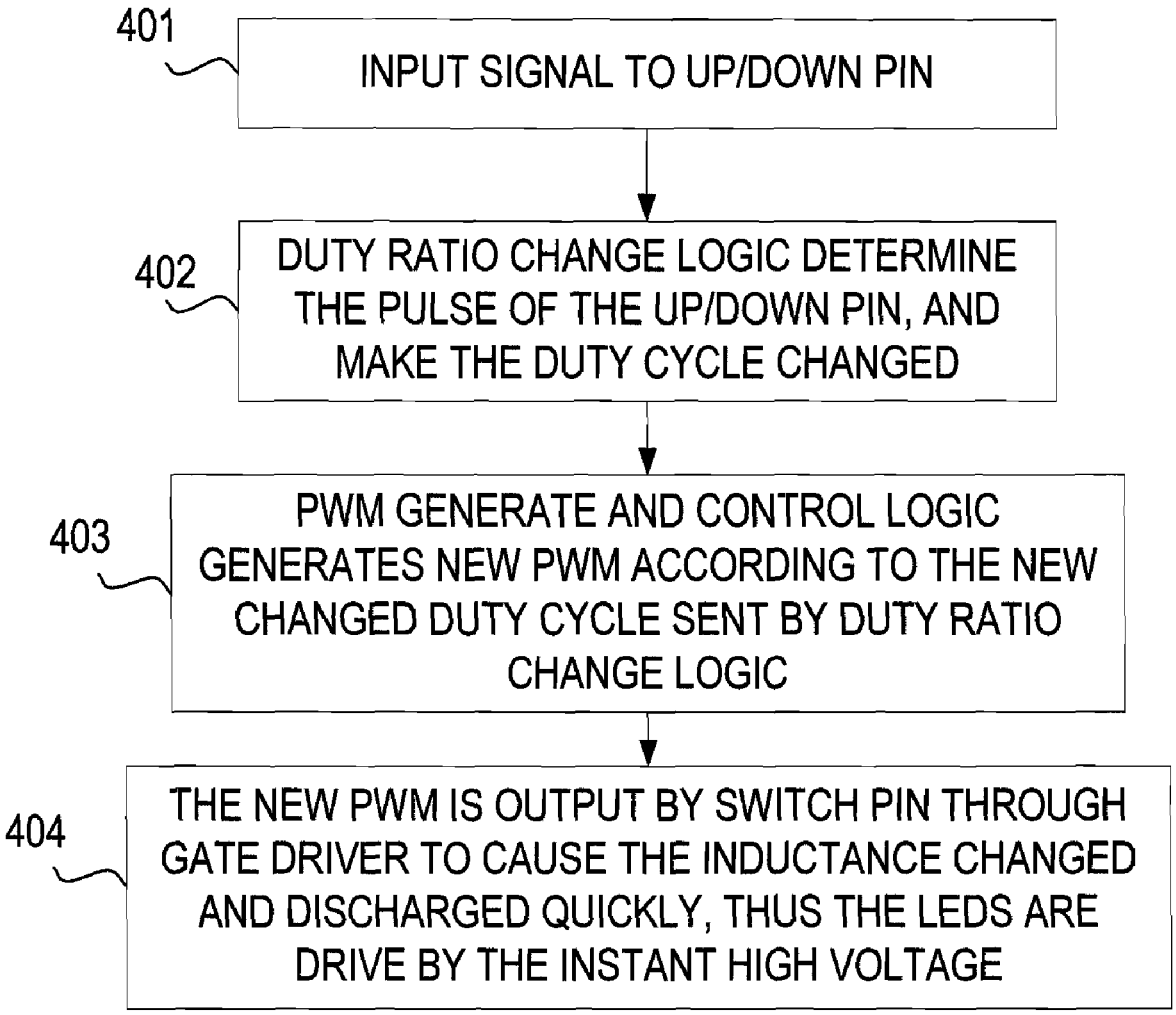
FIG. 4 illustrates a flow chart of the operation of the LED driver, in accordance with one embodiment of the present invention.

FIG. 4 illustrates a block diagram of the operation of the LED driver system 300. Referring to FIG. 3, the Duty Ratio Change Logic 302 receives an external input signal from one of the first (UP) pin/second (DOWN) pin, step 401. The signal can be, but not limited to pulse. The signal indicates the desired luminance of the light emitting diodes.

The Duty Ratio Change Logic 302 senses the pulse of the external input signal in high or low state, step 402. The external input signal is from first (UP) pin and indicates the desired luminance of the light emitting diodes. When the first (UP) pin receives the external input signal, the Duty Ratio Change Logic 302 senses the pulse of the input signal. The Duty Ratio Change Logic 302 will increase the duty cycle and set it as a new duty cycle if the pulse of the signal is high. The Duty Ratio Change Logic 302 will not change the duty cycle if the pulse of the signal from the first (UP) pin is low.

The Duty Ratio Change Logic 302 senses the pulse of the external input signal in high or low state, step 402. The external input signal is from second (DOWN) pin and indicates the desired luminance of the light emitting diodes. When the second (DOWN) pin receives the external input signal, the Duty Ratio Change Logic 302 estimates the pulse of the input signal. The Duty Ratio Change Logic 302 will decrease the duty cycle if the pulse of the input signal from the second (DOWN) pin is high. The Duty Ratio Change Logic 302 will not change the duty cycle if the pulse of the signal from the second (DOWN) pin is low.

The Duty Ratio Change Logic 302 transfers the new duty cycle to the PWM Generate and Control Logic 303, step 403 The PWM Generate and Control Logic 303 will generate a new PWM signal according to the new duty cycle sent by the Duty Ratio Change Logic 302.

In the fourth operation 404 of the method of FIG. 4, the Gate Driver 305 controls the opening and closing of the switch Q1 according to the new PWM signal. The inductor 312 is charged and discharged quickly through the opening and closing of the switch Q1. The LEDs 320 are driven by the instant voltage from the quick charge and discharge of the inductor 312. The current Io changes according to the PWM signal. If the Io exceeds the pre-determined value, the comparator 310 will send a low pulse to the PWM Generate and Control Logic 303 to stop the generation of the PWM signal to protect the LEDs 320.

Figure 5:
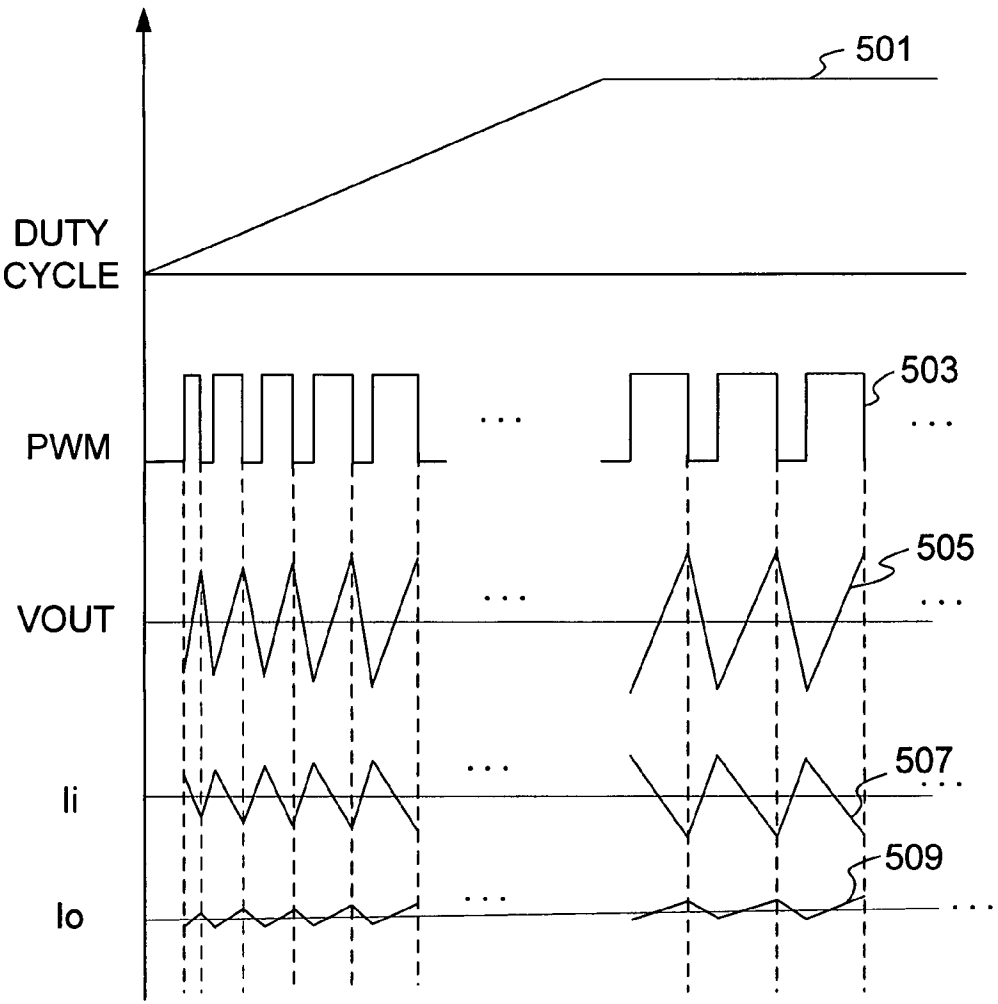
FIG. 5 illustrates a timing sequence diagram of the LED driver in operation, in accordance with one embodiment of the present invention.

FIG. 5 illustrates a timing sequence diagram of the LED driver circuit 301 in operation. The external input signal is received from the first (UP) pin. The curve 501 represents the waveform of the value of the duty cycle output by the Duty Ratio Change Logic 302 and the waveform changes according to the external input signal from the first (UP) pin. The duty cycle output increases when the duration of the high pulse of the input signal from the first (UP) pin increases. The duty cycle output will reach the highest point when the duration of the high pulse of the input signal exceeds a predetermined value.

The curve 503 represents the waveform of the PWM signal output by the PWM Generate and Control Logic 303. The curve 505 represents the waveform of the voltage at the node 318 (Vout) between the inductor 312 and the switch Q1. The voltage Vout at the node 318 increases when the duty cycle of the PWM signal increases. The curve 507 represents the waveform of the current of the inductor 312 (Ii). The current Ii increases when the duty cycle of the PWM signal increases. The curve 509 represents the waveform of the current of the LEDs (Io). The current Io increases when the duty cycle of the PWM signal increases.

At a time, only one of the first (UP) pin and second (DOWN) pin receives the input signal. FIG. 5 only illustrates the timing sequence diagram when the input signal is from the first (UP) pin. It is easily realized by those skilled in the art, when the input signal is from the second (DOWN) pin, the value of the duty cycle decreases when the duration of the high pulse of the input signal from the second (DOWN) pin increases. The duty cycle is output by the Duty Ratio Change Logic 302. The voltage Vout at the node 318 decreases when the duty cycle of the PWM signal increases. The current Ii decreases when the duty cycle of the PWM signal increases. The current Io decreases when the duty cycle of the PWM signal increases, therefore the luminance of the LEDs 320 decreases.

It can be seen from what has been described so far that if the input signal is received from the first (UP) pin, the Duty Ratio Change Logic 302 will increase the output duty cycle when the time of the high pulse of the input signal accumulates. If the input signal is from the second (DOWN) pin, the Duty Ratio Change Logic 302 will decrease the output duty cycle when the time of the high pulse of the input signal accumulates. The PWM Generate and Control Logic 303 generates different PWM signals according to the different duty cycles from the Duty Ratio Change Logic 302. The Duty Ratio Change Logic 302 and the PWM Generate and Control Logic 303 both take the signal from the oscillator 304 for timing reference, wherein the Duty Ratio Change Logic 302 counts the input signal from the first (UP) pin/second (DOWN) pin according to the frequency of the signal from the oscillator 304 to output the duty cycle. Therefore, the Duty Ratio Change Logic 302 changes the duty cycle linearly. Through this method, the LED's luminance will be changed linearly and light will not flicker.

The terms and expressions that have been employed herein are used as terms of description and not of limitation, and there is no intention, in the use of such terms and expressions, of excluding any equivalents of the features shown and described (or portions thereof), and it is recognized that various modifications are possible within the scope of the claims. Other modifications, variations, and alternatives are also possible.

What is claimed is:

1. An apparatus for driving a plurality of light emitter comprising:
a duty ratio change logic set having at least one connector for inputting a signal;
a second logic set for generating a PWM signal according to a control signal from said duty ratio change logic set;
a gate driver for receiving said PWM signal to control opening and closing of a switch; and
an inductor for generating a current, wherein the current being capable of driving the plurality of light emitters.

2. The apparatus of claim 1, wherein said signal being a pulse that indicates a desired luminance of said plurality of light emitter.

3. The apparatus of claim 1, wherein said duty ratio change logic set being capable of adjusting duty cycle of said control signal when duration of high pulse of said signal changes.

4. The apparatus of claim 1 further comprising:
an oscillator for providing a timing signal to said second logic set for timing reference.

5. The apparatus of claim 1 further comprising:
a comparator coupled to said second logic set, the comparator being capable of comparing a reference voltage and a feedback voltage from said plurality of light emitters and sending an output signal for stopping said second logic set from generating the PWM signal.

6. The apparatus of claim 1 further comprising:
an overvoltage protection circuitry coupled to said second logic set, wherein said overvoltage protection circuitry receives an input voltage for said plurality of light emitters and sends a stop signal to said logic set when said input voltage exceeds a predetermined value.

7. The apparatus of claim 1 further comprising:
a temperature protection circuitry coupled to said second logic set, wherein said temperature protection circuitry monitors a temperature of said plurality of light emitters, and sends a stop signal to said second logic set when said temperature exceeds a predetermined value.

8. A method of driving a plurality of light emitters, comprising:
receiving an input signal of desired luminance from a duty ratio change logic set;
adjusting a duty cycle of a control signal output by said duty ratio change logic set according to said input signal;
sending said control signal to a second logic set;
generating a PWM signal according to said control signal;
charging and discharging alternately at least one storage element according to the PWM signal; and
driving said plurality of light emitters with a current from the at least one storage element.

9. The method of claim 8, wherein said duty ratio change logic set having a first connector and a second connector, and at any time, only one of the connectors receiving the input signal.

10. The method of claim 9, further comprising:
determining said input signal is from the first connector or the second connector of said duty ratio change logic set;
increasing the duty cycle of said control signal when the input signal is from the first connector and the input signal is in high pulse state; and
decreasing the duty cycle of said control signal when the input signal is from the second connector and the input signal is in high pulse state.

11. A display system comprising:
a liquid-crystal-display (LCD) module for displaying visual information;
a plurality of light emitters coupled said LCD module for providing backlighting to said LCD module;
a plurality of light emitter driver circuits coupled to said plurality of light emitters, the plurality of light emitter driver circuits being capable of controlling luminance by manual input signals; and
a central processing unit (CPU) coupled to said plurality of light emitter driver circuits for providing intensity information for the display systems,
wherein each light emitter driver circuit comprises a duty ratio change logic set, a second logic set and a gate driver.

12. The display system of claim 11, wherein said each light emitter driver circuit further comprising:
an inductor for generating a current, wherein the current being capable of driving the plurality of light emitters.

13. The display system of claim 11 further comprising:
an array controller coupled to said central processing unit, the array controller being capable of providing a communication interface between said central processing unit and said plurality of light emitter driver circuits.

14. The display system of claim 11, further comprising:
at least one light sensor circuit for collecting sensor data relative to the display system provided by said plurality of light emitters.

15. The display system of claim 11, further comprising:
a front panel interface coupled to said central processing unit for acquiring desired intensity information for said plurality of light emitters.

16. The display system of claim 11, wherein said duty ratio change logic set has at least one connector for inputting a signal, said second logic set generates a PWM signal according to a control signal from said duty ratio change logic set, and said gate driver receives said PWM signal to control opening and closing of a switch.

* * * * *